US011781351B2

(12) United States Patent
Chirumbolo

(10) Patent No.: US 11,781,351 B2
(45) Date of Patent: Oct. 10, 2023

(54) DOOR-LOCK DEVICE FOR HOUSEHOLD APPLIANCE, IN PARTICULAR DISHWASHERS

(71) Applicant: Illinois Tool Works Inc., Glenview, IL (US)

(72) Inventor: Dino Chirumbolo, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 477 days.

(21) Appl. No.: 16/632,487

(22) PCT Filed: Jul. 24, 2018

(86) PCT No.: PCT/US2018/043447
§ 371 (c)(1),
(2) Date: Jan. 20, 2020

(87) PCT Pub. No.: WO2019/023206
PCT Pub. Date: Jan. 31, 2019

(65) Prior Publication Data

US 2021/0164275 A1 Jun. 3, 2021

(30) Foreign Application Priority Data

Jul. 24, 2017 (IT) ..... 102017000084013

(51) Int. Cl.
*E05C 3/00* (2006.01)
*A47L 15/42* (2006.01)
*E05B 15/00* (2006.01)

(52) U.S. Cl.
CPC ..... *E05C 3/008* (2013.01); *A47L 15/4259* (2013.01); *E05B 15/0046* (2013.01)

(58) Field of Classification Search
CPC .... F24C 15/022; Y10S 292/69; Y10S 292/24; Y10T 292/1047; Y10T 292/1078;
(Continued)

(56) References Cited

U.S. PATENT DOCUMENTS 3,291,512 A 12/1966 Lewin
6,390,518 B1 * 5/2002 Elick ..... E05C 3/24 292/96

(Continued)

FOREIGN PATENT DOCUMENTS

EP 2159358 A2 3/2010
GB 500987 A 2/1939
WO 2015150051 A1 10/2015

OTHER PUBLICATIONS

International Search Report for PCT/US2018/043447, dated Aug. 28, 2018.
Italian Search Report for IT 2017/00084013, dated Jul. 24, 2017.

*Primary Examiner* — Mark A Williams
(74) *Attorney, Agent, or Firm* — Boyle Fredrickson, S.C.

(57) ABSTRACT

A door-lock device for appliances, such as dishwashers, is provided. The door-lock device includes a support, and a lock wheel rotationally carried by the support around an axis of rotation. The lock wheel includes a hub and a plurality of locking arms that radially protrude from the hub. The hub may include a plurality of retention surfaces, and at least one retention element. The at least one retention element may be elastically pressed into contact with the hub to hold the lock wheel in a plurality of locking positions.

10 Claims, 6 Drawing Sheets

(58) Field of Classification Search
CPC ..... Y10T 292/0945; Y10T 292/1052; A47L 15/4259; A47L 2401/26; E05C 5/00; E05C 2005/005; E05C 1/08; E05C 3/008; D06F 39/14; E05B 2047/0024; E05B 47/0607; E05B 47/023; E05B 15/0046
See application file for complete search history.

(56) References Cited

U.S. PATENT DOCUMENTS

| | | | | |
|---|---|---|---|---|
| 7,956,304 | B2 * | 6/2011 | Bacigalupe | H01H 9/226 200/61.81 |
| 2006/0232077 | A1 * | 10/2006 | Courter | F24C 15/022 292/201 |
| 2008/0042447 | A1 * | 2/2008 | Neumann | E05C 19/02 292/216 |
| 2008/0185849 | A1 * | 8/2008 | Hartmann | A47L 15/4259 292/60 |
| 2008/0196707 | A1 * | 8/2008 | Chirumbolo | F24C 15/022 292/199 |
| 2010/0102572 | A1 * | 4/2010 | Burmesch | E05B 47/0012 292/201 |
| 2013/0234578 | A1 * | 9/2013 | Ala | E05B 15/0086 292/220 |
| 2014/0035294 | A1 * | 2/2014 | Promutico | E05C 3/16 292/96 |
| 2015/0267446 | A1 * | 9/2015 | Promutico | E05B 47/0038 292/122 |
| 2016/0251879 | A1 * | 9/2016 | Behnke | E05B 85/245 292/200 |
| 2018/0163433 | A1 * | 6/2018 | Schmidt | E05C 3/22 |
| 2020/0178757 | A1 * | 6/2020 | Fawaz | A47L 15/507 |

* cited by examiner

DOOR-LOCK DEVICE FOR HOUSEHOLD APPLIANCE, IN PARTICULAR DISHWASHERS

FIELD OF THE INVENTION

This invention concerns a door-lock device for appliances, in particular for dishwashers.

DESCRIPTION OF THE RELATED TECHNIQUE

EP-A-2643535 of the same Applicant describes a door-lock device for appliances, in particular for dishwashers, comprising a support frame, a lock element rotationally carried by the support frame around an axis which is transversally movable with respect to the support frame. The lock element cooperates with elastic means that make the lock element rotate between a first set position wherein the lock element engages a door strike and a second set position wherein the lock element does not engage the door strike.

The door-lock device known from EP-A-2643535 is subject to certain inconveniences, among which:

- a floating mechanism is necessary to rearrange the lock element after the opening of the door;
- the lock element is held in a set manner in the open position and in the closed position by means of helical springs under traction which exhibit lesser characteristics as regards duration and reliability,
- the door-lock device comprises a high number of components and it is hardly compact.

Purpose and Synthesis of the Invention

The aim of this invention is that of supplying a door-lock device for appliances that overcomes the inconveniences of the prior art.

According to this invention, this purpose is achieved by a door-lock device having the characteristics forming the object of claim 1.

As regards the invention, the claims are an integral part of the teaching provided.

BRIEF DESCRIPTION OF THE DRAWINGS

This invention will be described in detail with reference to the annexed drawings, data that are provided merely as an example and without limitation, wherein.

DETAILED DESCRIPTION

Figure 1:
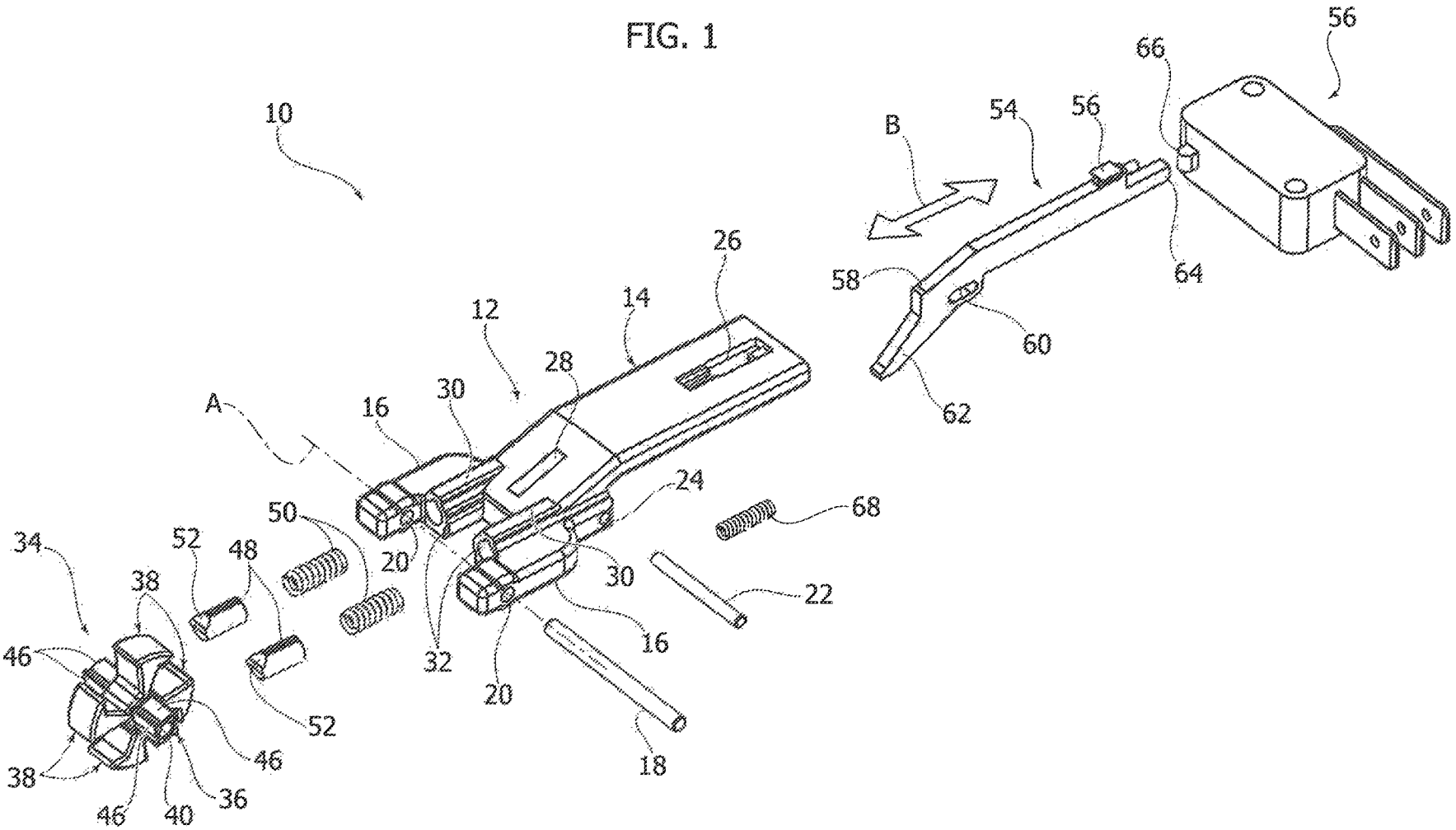
FIG. 1 is an exploded perspective view of a door-lock device according to this invention.

With reference to FIG. 1, the number 10 indicates a door-lock device for appliances, in particular for dishwashers.

The door-lock device 10 comprises a support 12 which can be made up of injection molded plastic material. The support 12 can comprise a central part 14 and two support arms 16 extending from the central part. 14 according to a general forked configuration. The two support arms 16 carry a first pivot 18 which defines an axis of rotation A which is fixed with respect to the support 12. The pivot. 18 can be inserted through the respective holes 20 of the support arms 15 aligned in relation to each other along the axis A, and which retain the opposite ends of the first pivot 18.

The support 12 can carry a second pivot 22 which is parallel to the first pivot 18 and inserted in holes 24 of the central part 14.

The central part 14 of the support 12 can have first guidance groove 26 and a second guidance groove 28 which are orthogonally oriented with respect to the axis of rotation A.

The support 12 can comprise two guidance portions 30 having their respective seats 32 orthogonally oriented to the axis of rotation A. The guidance portions 30 can be located adjacent to the respective support arms 16 and on the inside with respect to the support arms 16. The central part 14, the support arms 15 and the guidance portions 30 of the support 12 can be formed in one sole piece, for example, of injection molded plastic material.

The door lock device 10 comprises a lock wheel 34 rotationally carried by the support 12 around the axis A. The lock wheel 34 comprises a hub 35 and a plurality of locking arms 38 radially protruding from the hub 35. The hub 36 has a hole 40 through which the first pivot 18 extends. The hub 36 and the locking arms 38 can be formed in one sole piece, for example, of injection molded plastic material or of zinc alloy (for example, zamak). The locking arms 38 can be equidistantly arranged from one another, at an angle. In one or more embodiments, four locking arms 38, equidistantly arranged from one another at an angle of 90°, can be foreseen.

Figure 3:
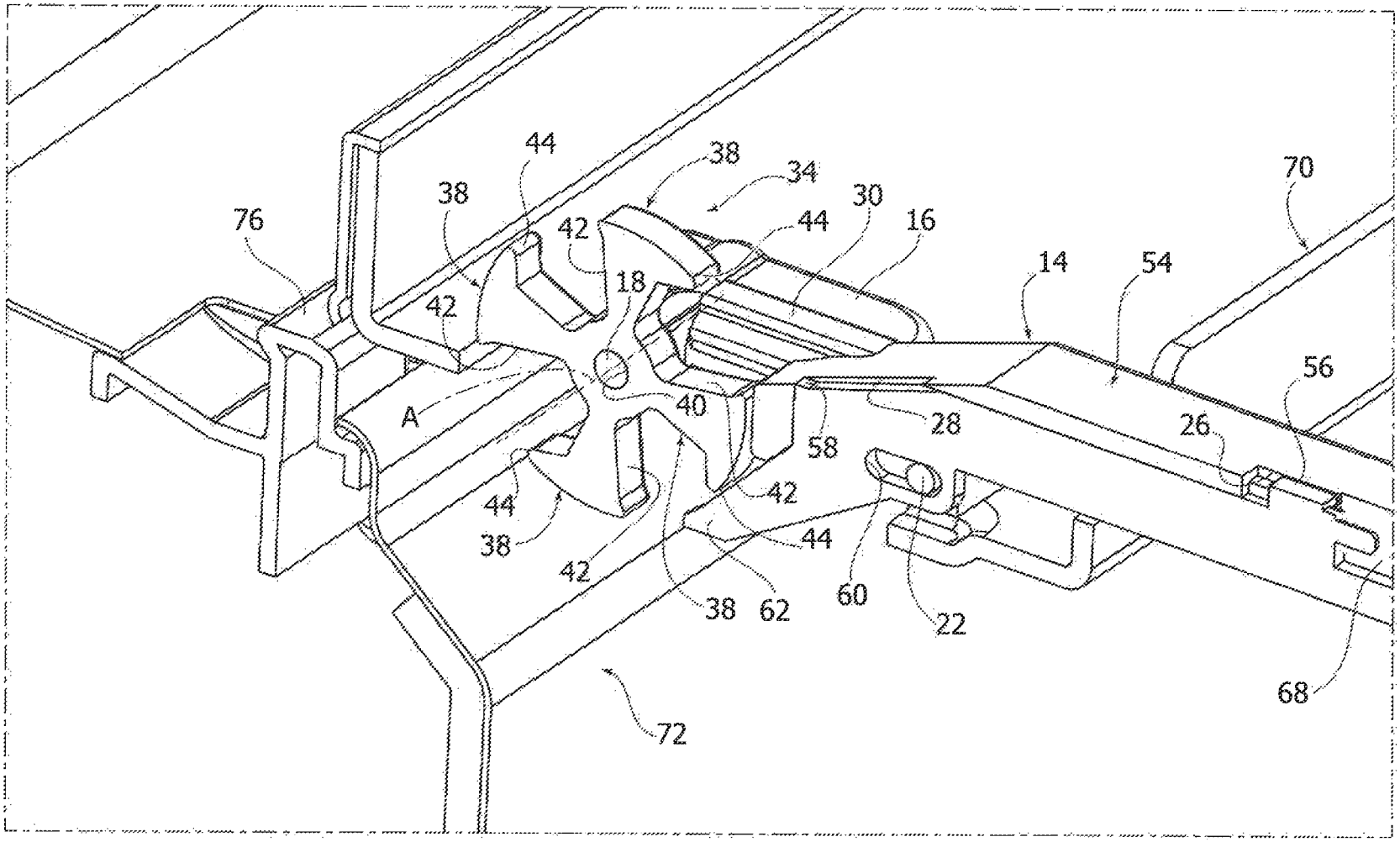
FIG. 3 is a partially sectioned perspective view of the part indicated by the arrow III in FIG. 2.
Figure 4:
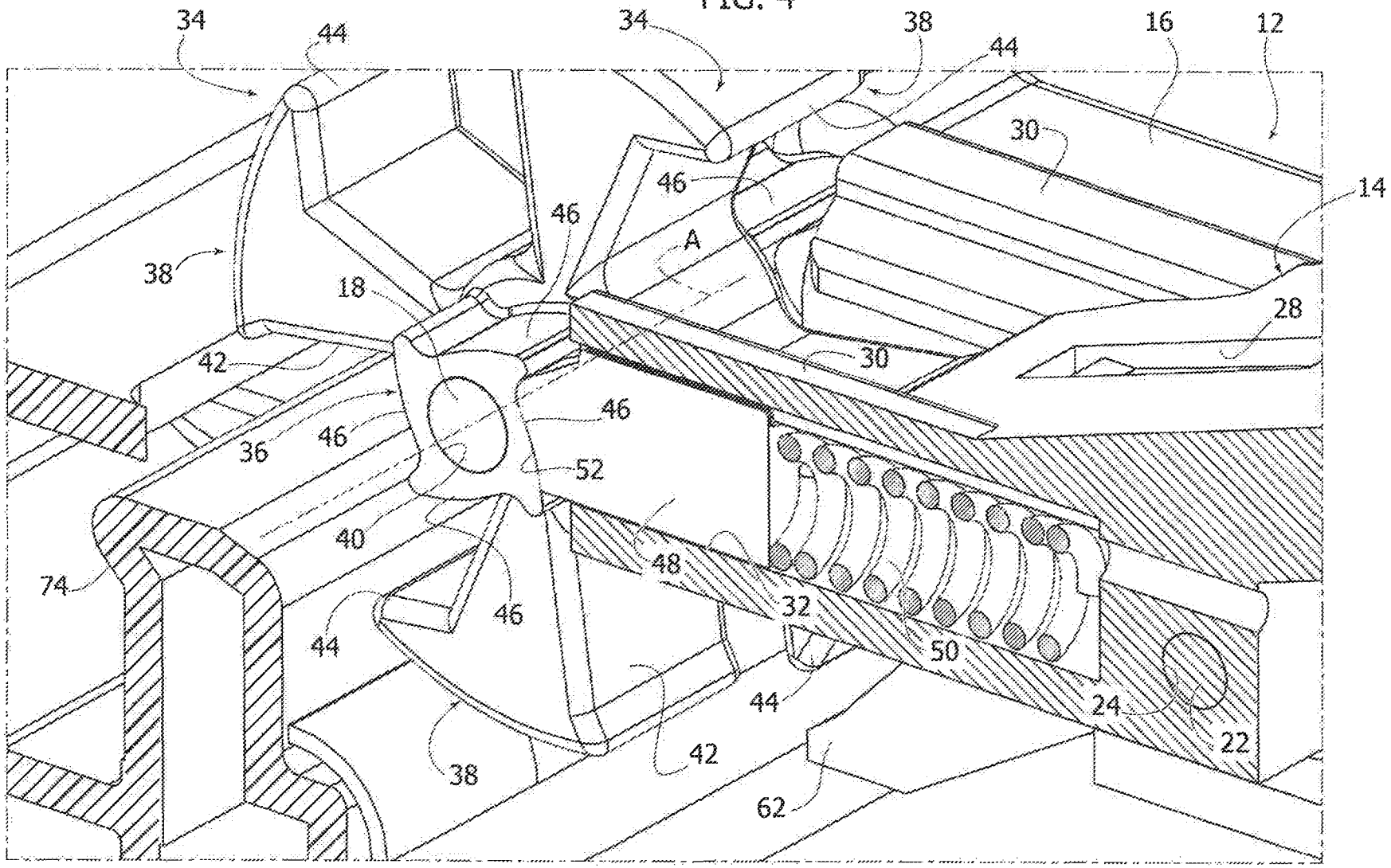
FIG. 4 is a perspective view of the part indicated by the arrow IV in FIG. 2, and FIGS. 5 and 5 are axial sections along the V-V line of FIG. 2 illustrating the closing phase of the door.

With reference to FIGS. 3 and 4, each locking arm 38 can have a radial stop surface 42 and a head having a circumferential protrusion 44.

The hub 36 can have two elongated sections in the direction of the axis A, located on opposite sides with respect to the locking arms 38. Each section of the hub 36 has an external cam surface, with a plurality of retention surfaces 46 which are identical to one another and spaced at an angle to one another around the axis A. The number of retention surfaces 46 can be equal to the number of the locking arms 38.

The lock wheel 34 can be rotated around the axis A, allowing for an angular extension greater than 360°. The lock device 10 comprises at least one retention element to hold the lock wheel 34 in a locking position. With reference to FIG. 1, in the illustrated embodiment, the door-lock device 10 comprises two retention elements 48 which cooperate with respective sections of the hub 36. The retention elements 48 are housed within their respective seats 32 of the guidance portions 30 of the support 12 and are movable with reference to the support 12 in a direction that is orthogonal with respect to the axis of rotation A. The retention elements 48 cooperate with respective helical springs 50, under compression, which press the retention elements 48 against the respective sections of the hub 36. The retention elements 48 have head surfaces 52 which can have a form which is complementary to that of the retention surfaces 46 of the hub 36. As illustrated in FIG. 4, each retention element 49 is housed in a respective seat 32 of the respective guidance portion 30 in a sliding manner along a direction that is orthogonal to the axis of rotation A. The head surface 52 of each retention element 48 is pressed into contact with the respective section of the hub 36. Each helical spring 50, under compression, is housed in a respective seat 32 and is arranged between a rear wall of the seat 32 and an inside wall of the retention element 48. The helical springs 50 elastically press the retention elements 48 in contact with one of the retention surfaces 46 of the hub 36. The elastic force of the springs 50 retains the lock wheel 34 in a set position. In order to make the lock wheel 34 rotate around the axis A, it is necessary to apply a torque to the wheel that is sufficient to make the retention elements 48 retract into their respective seats 32 against the force of the springs 50. The shape of the retention surfaces 46 can be asymmetrical in such a way that the necessary torque to make the lock wheel 34 rotate in an unlock direction (clockwise direction in FIGS. 3 and 4) is greater than the torque necessary to make the lock wheel 34 rotate in a lock direction (counter-clockwise direction in FIGS. 3 and 4).

With reference to FIGS. 1 and 3, the door-lock device 10 can comprise a door detection indicator 54 which cooperates with a door detection switch 56. The door detection indicator 54 is carried by the support 12 in a movable manner along a direction B which is orthogonal with respect to the axis of rotation A. The door detection indicator 54 can have a protrusion 56 which engages the first guidance groove 26 of the central part 14 and an edge 58 which engages the second guidance groove 28 of the central part 14. The door detection indicator 54 has a eyelet 60 through which the second pivot 22 of the support 12 is inserted, in such a way to define two end positions of the door detection indicator 54 with respect to the support 12. The door detection indicator 54 has a first end 62 which cooperates with the appliance door and a second end 64 which cooperates with a button 66 of the door detection switch 56. The door detection indicator 54 cooperates with a helical spring 68 which tends to elastically push the door detection indicator 54 towards the appliance door.

Figure 2:
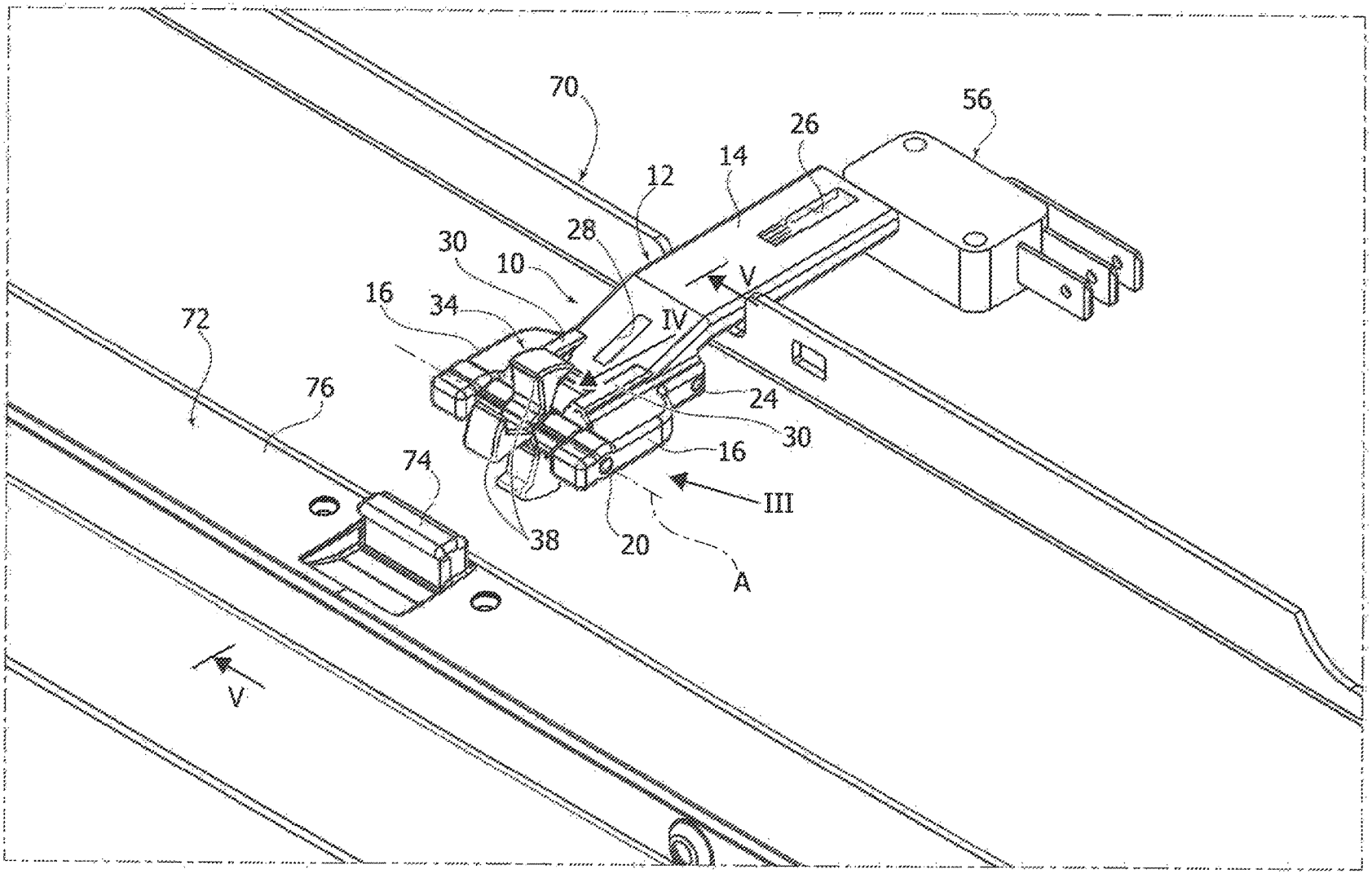
FIG. 2 is a perspective view illustrating the door-lock device of FIG. 1 mounted on an appliance.

FIG. 2 schematically shows the door-lock device 10 fixed to an upper cross member 70 of a dishwasher basin. The support 12 of the door-lock device 10 can be fixed to the dishwasher basin by means of a snap engagement or one with fastening screws. The means to fix the support 12 to the dishwasher basin are not shown. In FIG. 2 the support of the door detection switch 56 is also not shown. In FIG. 2 the door detection switch 56 is shown oriented transversally, in such a way that the door detection indicator 54 directly operates the button 66 of the switch 56. Alternatively, the door detection switch 56 could be oriented parallel to the direction of movement of the door detection indicator 54 and, in this case, the button 56 could be operated by means of a cam. In dishwashers provided with an automatic door-opening device, the support 12 of the door-lock device 10 could be fixed to the movable element of the automatic door-opening device.

In FIG. 2, the number 72 indicates a dishwasher door that is articulated around a lower horizontal axis. The door 72 comprises a strike 74 protruding from an upper edge 76 of the door 72.

Figure 5:
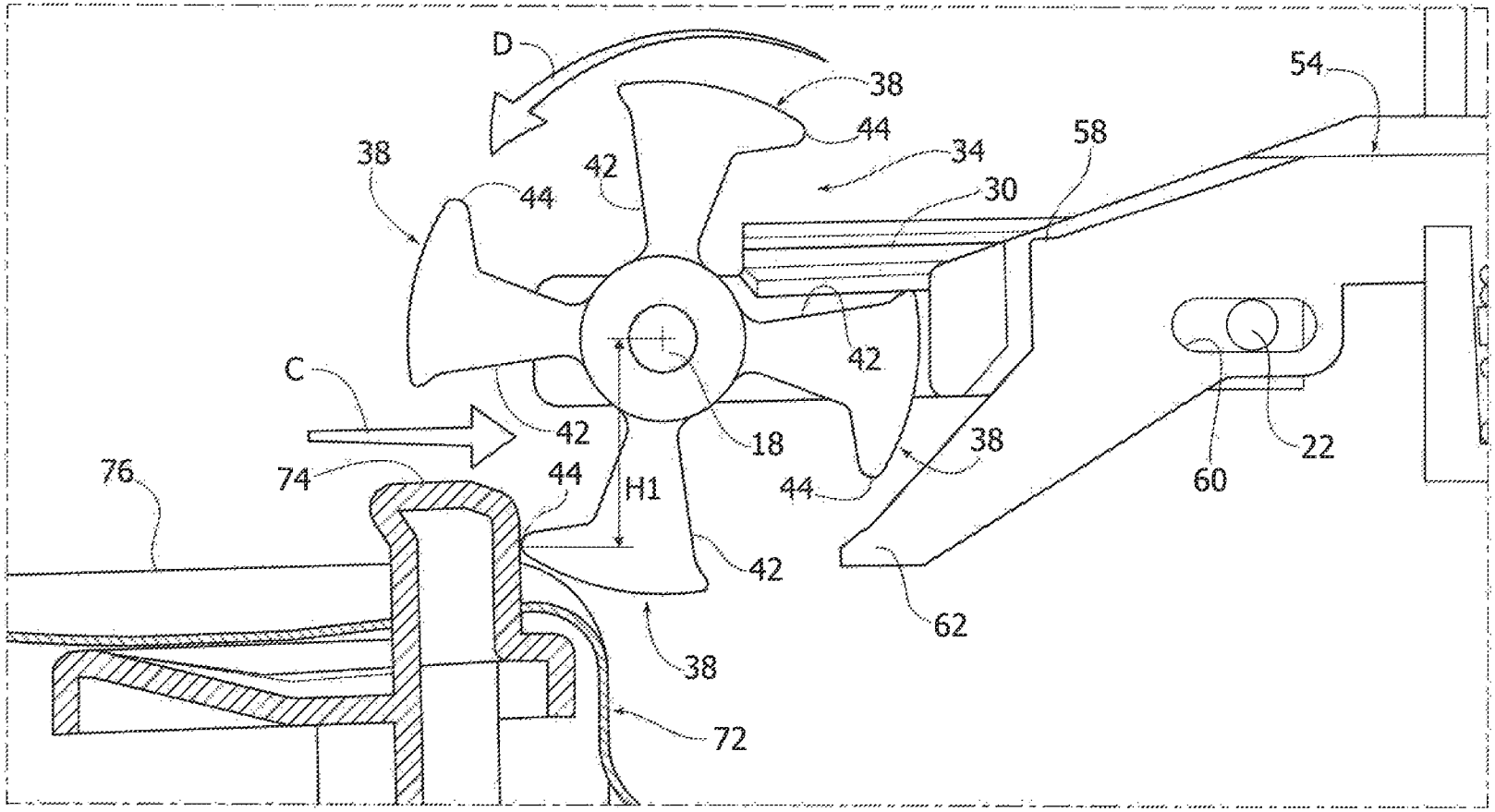

With reference to FIG. 5, as the door 72 closes, the strike 74 comes into contact with the circumferential protrusion of one of the locking arms 38 of the lock wheel 34. The movement of the strike 74 in the closing direction, indicated by the arrow C in FIG. 5, provokes the rotation of the lock wheel 34 around the axis A in the direction indicated by the arrow D.

Figure 6:
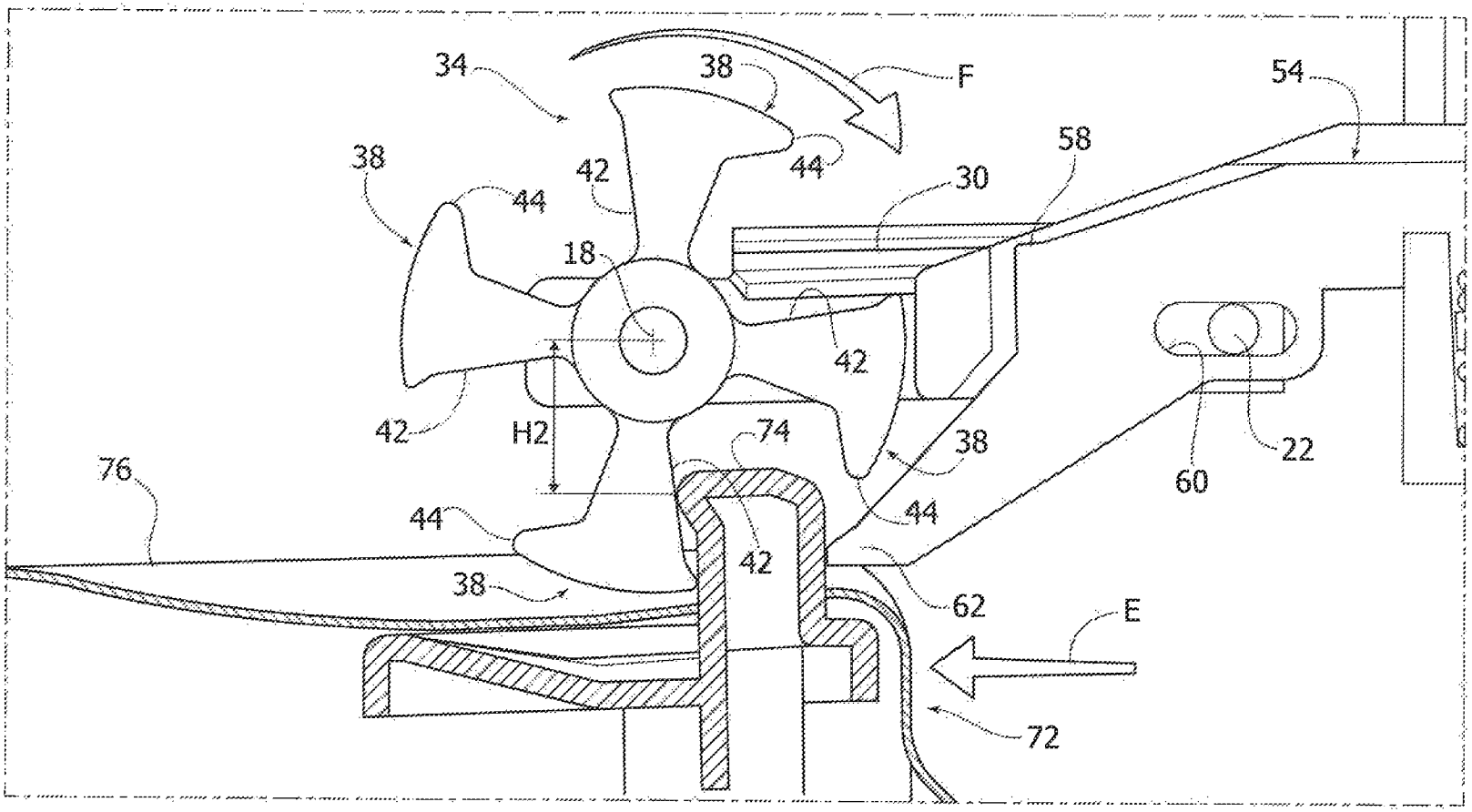

FIG. 6 shows the door 72 in the closed position. In this position, with respect to the position of FIG. 5, the lock wheel 34 is rotated by an angle equal to the angular pitch between the locking arms 38. The radial wall 42 of one of the locking arms 38 blocks the strike 74 in the closed-door position. The strike 74 in the closed-door position comes into contact with the door detection indicator 54 and pushes it towards a closed-door position in which the indicator 54 pushes the button 66 of the door detection switch 56. In this state, the door detection switch 56 sends a signal which indicates that the door 72 is closed and locked.

In the configuration of FIG. 6, the door 72 opens in the direction indicated by the arrow H and provokes a rotation of the lock wheel 34 in the direction indicated by the arrow F.

The shape of the heads of the locking arms 38 is such that the force required to close the door 72 is less than the force required to open it. This because, during the closing (FIG. 5), the strike 74 engages a locking arm 38 at a distance H1 from the axis of rotation, which is greater than the distance of engagement H2 in the opening phase (FIG. 6) Moreover, the retention surfaces 46 of the hub 36 can be asymmetrical in such a way to require a lesser torque for the rotation of the lock wheel in the closing direction and a greater torque of the lock wheel 34 in the opening direction.

The opening and closing force can vary depending on the application, using springs 50 having different stiffness.

The door-lock device according to this invention can present one or more of the following advantageous elements;

- the device has a more compact design than that of other devices that are currently on the market;
- the device does not require a bistable floating mechanism given that the lock wheel 34 always has a locking arm in the engagement position;
- the device uses springs under compression that have a greater lifespan and reliability than the traction springs;
- the device has a lower number of components than that of other devices that are currently on the market.

Naturally, notwithstanding the basic principles, it is possible that there are variations, including considerable ones, in the construction particulars and the embodiments, when compared to that which is described and illustrated, without however straying from the scope of protection. Said scope of protection is defined in the claims below.

The invention claimed is:

1. A door-lock device for an appliance with a door that is movable between a door-opened position to a door-closed position during a closing phase of the door, the door-lock device comprising:

- a support;
- a lock wheel rotationally carried by the support around an axis of rotation, in which the lock wheel comprises a hub and a plurality of locking arms radially protruding from the hub, wherein the hub comprises a plurality of retention surfaces,
- at least one retention element elastically pressed into contact with the hub to hold the lock wheel in a plurality of locking positions;
- a strike having an outer end that is fixed in position relative to the door and that engages the lock wheel during the closing phase of the door to rotate the lock wheel;

wherein:

- the strike and lock wheel engage each other at different engagement interfaces that are positioned at different radial distances from the axis of rotation during closing and opening phases of the door to provide different closing and opening forces corresponding to closing and opening the door.

2. The door-lock device of claim 1, in which the support comprises two support arms carrying a first pivot defining the axis of rotation.

3. The door-lock device of claim 1, comprising two retention elements which act upon respective hub sections to retain the lock wheel in a set position.

4. The door-lock device of claim 3, wherein the retention elements are housed within respective seats of the support and are movable in a direction that is orthogonal with respect to the axis of rotation.

5. The door-lock device of claim 4, wherein the retention elements are elastically pushed towards the retention surfaces of the hub by means of respective helical springs, under compression.

6. The door-lock device of claim 1, comprising a door detection indicator carried by the support and movable in a direction that is orthogonal with respect to the axis of rotation for providing an indication of a door closed and locked state.

7. The door-lock device of claim 6, wherein the door detection indicator has an eyelet engaged by a second pivot carried by the support wherein the eyelet defines a slot with two ends that correspond to end positions of the door detection indicator with respect to the support.

8. A door-lock device for appliances, comprising:

a support;

a lock wheel rotationally carried by the support around an axis of rotation, in which the lock wheel comprises a hub and a plurality of locking arms radially protruding from the hub, wherein the hub comprises a plurality of retention surfaces, at least one retention element elastically pressed into contact with the hub to hold the lock wheel in a plurality of locking positions; and a door detection indicator carried by the support and movable in a direction that is orthogonal with respect to the axis of rotation;

wherein the door detection indicator has a first end which cooperates with a strike of the door and a second end which cooperates with a button of a door detection switch.

9. The door-lock device of claim 6, wherein the door detection indicator cooperates with a spring arranged to push the door detection indicator towards a strike of the door.

10. A door-lock device for an appliance with a door that is movable between a door-opened position to a door-closed position during a closing phase of the door, the door-lock device comprising:

a support;

a lock wheel rotationally carried by the support around an axis of rotation, in which the lock wheel comprises a hub and a plurality of locking arms radially protruding from the hub, wherein the hub comprises a plurality of retention surfaces, at least one retention element elastically pressed into contact with the hub to hold the lock wheel in a plurality of looking positions; and a strike having an outer end that is fixed in position relative to the door and that engages the lock wheel during the closing phase of the door to rotate the look wheel; and wherein:

the lock wheel and the strike engage each other at:

a first position that is spaced a first distance from the axis of rotation during a closing phase of a door, wherein the lock wheel rotates in a first direction during the closing phase of the door;

a second position that is spaced a second distance from the axis of rotation during an opening phase of the door, wherein the lock wheel rotates in a second direction during the opening phase of the door;

the first distance is greater than the second distance and less force is required during the closing phase to close the door than during the opening phase to open the door.

* * * * *